US005954037A

United States Patent [19]

Grimes

[11] Patent Number: 5,954,037

[45] Date of Patent: Sep. 21, 1999

[54] REDUNDANT MAGNETO FOR RACE CAR

[76] Inventor: French Grimes, Rte. 603, HC 6 Box 240, Haywood, Va. 22722

[21] Appl. No.: 09/110,583

[22] Filed: Jul. 6, 1998

Related U.S. Application Data

[63] Continuation-in-part of application No. 08/796,413, Feb. 6, 1997, abandoned.

[51] Int. Cl.[6] ..... F02P 15/00; F02P 9/00

[52] U.S. Cl. ..... 123/640; 123/609; 123/622

[58] Field of Search ..... 123/640, 630, 123/620, 634, 599, 149 FA, 649, 609, 622, 406.56; 324/389

[56] References Cited

U.S. PATENT DOCUMENTS

| | | | |
|---|---|---|---|
| 1,308,503 | 7/1919 | Martire | 123/640 |
| 2,015,091 | 9/1935 | Spohn . | |
| 2,286,232 | 6/1942 | Scott | 123/640 |
| 3,759,237 | 9/1973 | Shino et al. | 123/640 |
| 3,972,315 | 8/1976 | Munden et al. | 123/640 |
| 3,980,922 | 9/1976 | Katsumata et al. | 123/599 |
| 5,331,935 | 7/1994 | Daino | 123/640 |

FOREIGN PATENT DOCUMENTS

| | | | |
|---|---|---|---|
| 516206 | 9/1955 | Canada | 123/640 |

*Primary Examiner*—Willis R. Wolfe
*Assistant Examiner*—Hieu T. Vo
*Attorney, Agent, or Firm*—Donavon Lee Favre

[57] ABSTRACT

The present invention is directed to a magneto having two sets of primary windings and no secondary windings which will allow the magneto to function as an ignition source even though one set of primary windings fail. Each primary winding provides current to an independent set of points, condensers, high voltage transformers, and then to a common distributor. The magneto will also continue to function even though one set of points, one condenser, one high voltage transformer or one secondary winding fails. The primary windings are formed, by winding two wires joined by insulation onto a common laminated core.

9 Claims, 4 Drawing Sheets

FIG. 2
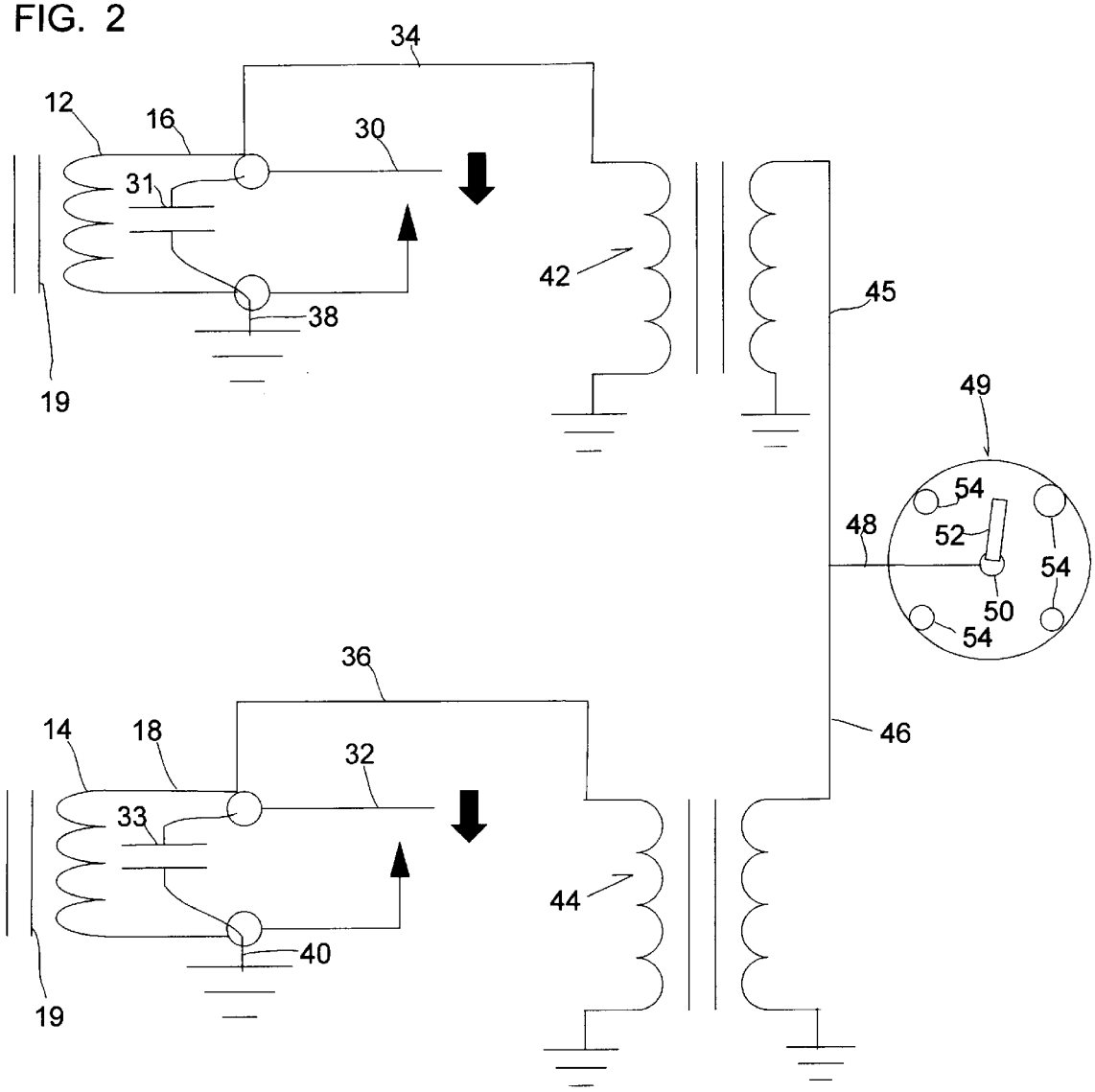
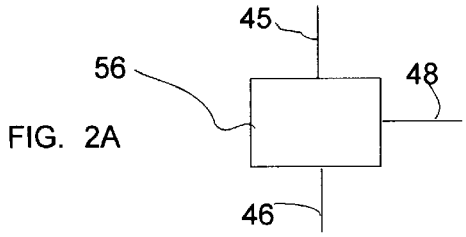
FIG. 2A

REDUNDANT MAGNETO FOR RACE CAR

CROSS REFERENCE TO RELATED APPLICATIONS

This application is a continuation in part of patent application Ser. No. 08/796,413 of French Grimes, filed Feb. 6, 1997, now abandoned.

STATEMENT REGARDING FEDERALLY SPONSORED RESEARCH OR DEVELOPMENT

Not Applicable

BACKGROUND OF THE INVENTION

U.S. Pat. No. 1,308,503 Martire (1919) at page 1 lines 10 through 18, discloses a switch for acutuating one or more internal combustion engines by means of either or both of two ignition magnetos, the starting of one or more of the engines being eventually effected by a single ignition magneto, and each engine and each magneto being independently operated. The switch does not provide for combining the outputs of the two magnetos.

U.S. Pat. No. 2,015,091 Spohn (1935) discloses at claim 7 a two-spark ignition magneto for internal combustion motors. The magneto has a rotor and a separate stator for each of the two sparks. The rotor has a rotatable bearing-engaging central supporting structure having a series of permanent magnets spaced about the axis of rotation of the rotatable structure. Each stator comprises and a laminated core located adjacent the path of rotation of the magnets. The outputs of the two magnetos are not combined nor is their any suggestion that the two magnetos fire simultaneously. At page 2, lines 64 to page 3 line 2 it is stated "By reason of the fact that there are an odd number of magnets in the illustrated construction and that each set of spark coils cooperates only with a single magnet at a time to produce a spark, the two sets of spark coils will not be symmetrically arranged with respect to the rotor. In the illustrative embodiment of the invention the two coil sets are shown as so arranged with respect to each other that when in inductive relation to two of the magnets of the rotor there will be three magnets between the two coil sets on one side of the magneto and four magnets between the two coil sets on the other side of the magneto." It appears that one magneto supplies a retarded spark for starting an engine and a second magneto supplies an advanced spark for running the engine (see p.2, lines 22–25). The Spohn type magneto is also disclosed in U.S. Pat. No. 2,286,232 of Scott (1942).

U.S. Pat. No. 3,630,185 Wesemeyer et al (1971) discloses an electronic ignition system wherein two electrically different windings are successively influenced by a magnetic flux and generate different successive voltage pulses, of which the first generated has a lower peak value. The pulses are transmitted to the control electrode of an electronic switch which controls an ignition coil and a spark plug. At low starting speeds, the first voltage pulses are below the threshold voltage of the switch so that the spark is caused later by the second voltage pulse. At the high-normal speed of the combustion engine, the first voltage pulse exceeds the threshold voltage, and the spark is earlier produced.

U.S. Pat. No. 864,621 Haubner et al (1975) discloses an additional winding on the magneto of a magneto ignition system to provide base current over a capacitor-diode network and a current limiting resistor to the base of the ignition transistor to assure that the transistor will be switched and held conducting during positive half waves of the magneto output up to the moment of ignition when a control circuit blocks the ignition transistor. The control winding may be on a magneto armature that serves both to feed the ignition control circuit and to operate as a spark coil, or it may be on an entirely separate armature, or on the lighting system armature of the magneto. Instead of such a control winding, a transformer may be provided in the primary circuit to develop the control voltage.

U.S. Pat. No. 3,963,015 Haubner et al (1976) discloses an ignition system in which the spark coil is wound right on the magneto armature and the spark is produced by electronic interruption of a short circuit across the primary winding, the first of a succession of rectified half waves applied to the electronic circuit unit has its amplitude reduced either by insertion of a circuit component in one half wave path of the rectifier to provide damping, or by the configuration of the armature core, or both. The magneto rotor has a U-shaped permanent magnet, the pole faces on the end of the legs of which are rotated past opposed pose faces of the armature core, which has the desired effect if the latter is of asymmetric U-shape or of symmetrical E-shape.

U.S. Pat. No. 3,974,816 Henderson et al (1976) discloses an electronic ignition control system including one coil assembly having a high number of turns to charge the associated capacitors to a desired level when the speed of the engine is low, and another coil assembly having a low number of turns to charge the capacitors to a desired level when the speed of the engine is high to thereby provide energy at a suitable level to fire the associated spark plugs. Separate capacitors are utilized and each capacitor is isolated from the other capacitor in its charging and discharging action and switching devices are connected separately to each capacitor. Thus, if one capacitor or one of the switching devices shorts, those cylinders associated with the shorted capacitor or switching device will ceases functioning; however, the engine will continue to operate on those cylinders not associated with the shorted capacitor or switching device.

U.S. Pat. No. 4,911,126 Notaras (1990) discloses a multiple spark transistor ignition circuit which is able to provide negligible retardation of ignition time, and/or prevent ignition with reverse rotation and/or provide an additional advanced spark and/or govern maximum engine speed and/or progressively advance moment of ignition with increasing engine speed. The basic circuit comprises an ignition circuit with a diode interposed between the primary winding and the remainder of the circuit. Circuits having a single primary winding and dual remainders or dual primary winding and single remainders are also disclosed. A governor circuit having a control transistor, a further potential divider and a control capacitor, is also disclosed.

U.S. Pat. No. 5,544,633 Mottier (1996) discloses an ignition system for an internal combustion engine that operates in two modes. In a first mode, the timing of the spark event is under electronic control. In a second mode, the timing of the spark event is fixed and synchronized to the mechanical rotation of the crankshaft of the engine. Under normal operating conditions, the timing of the spark event is electronically controlled. If the electrical system of the engine malfunctions, the ignition system defaults to the second mode in which ignition timing is mechanically controlled. The above ignition system replaces the redundant magneto ignition systems historically used on aircraft engines.

The inventor, French Grimes, is an expert in the magneto art. He has a business of modifying magnetos for race car drivers. One of the modifications that he has made, and which has been successful for more than one year prior to the filing of the parent application, Ser. No. 08,796,413 has been the replacement of the primary and secondary windings in a magneto with a single primary winding. The output of the magneto is then fed to a high voltage transformer controlled by a set of points to provide ignition.

SUMMARY OF THE INVENTION

The present invention is directed to a magneto having two primary coils and no secondary coils. The two primary coils are wound on the same core, are coaxial and preferably identical. The two coils are wound using twin wires which are wound parallel on the core, each wire of the twin being the same radial distance from the core as its twin. It is essential that the two coils be identical and be placed on the same position on the same core; so that the AC output currents of two high voltage coils driven the two magneto primary coils complement each other when they are combined to produce an enhanced spark. In the prior art such as Scott, hysteresis differences, and magnetic force differences between the two primary magneto coils, such differences would cause the two output currents to be out of phase counterflow and reduce the combined current output. That is the current represented by areas of the two sign waves that are out of phase would cancel each other out and reduce the spark intensity of the Scott magneto. This may be a reason why Scott did not remotely suggest combining the output of his two magnetos to double his spark intensity. Another reason is that the Scott magnetos fired at different times to different plugs for totally different reasons, that is to provide one timing for starting, a second timing for running and a backup in case of failure of one magneto. Also for optimum additive effect, it is preferred that the wave forms of the two coil outputs be identical for maximum combined spark intensity another feature impossible with Scott.

Each primary magneto coil is electrically connected to a different set of the breaker points and condenser. Thus, if one magneto primary coil fails, the magneto will still function. To add further redundancy to the magneto, each of the sets of points is electrically connected to a separate high voltage transformer. In one mode the two sets of points are positioned on the magneto to open and close in the same sequence and time period. This configuration has the points positioned 180° apart on the distributor plate. To provide one ignition timing for starting an engine and acceleration, and a second advanced ignition timing for running the engine at high speed the two sets of points are positioned to open at different times. If the outputs from both high voltage transformers are electrically connected, this second ignition timing also provides a longer dwell time for an ignition spark initiated by both magnetos. The electrical connection between the high voltage outputs of the two high voltage transformers is preferably direct. Optionally the outputs can be coupled through a coupling unit which prevents direct electrical contact between the two high voltage transformers.

The choice between acceleration timing, high speed timing and longer dwell time is enabled by a three position switch which allows at the first position an ignition spark generated in response to the first set of points to open, at the second position a ignition spark generated by the last of the set of points to open, and at the third position a combination enhanced spark generated in response to the opening of both sets of points. Again the outputs of the two high voltage transformers are preferably directly electrically coupled, (optionally using an isolating coupling unit).

The preferred magneto of the present invention has a conventional permanent magnet pole wheel which rotates inside of a housing. Long pole shoes in the shape of inverted Ls have their first terminal ends positioned at equal angular intervals about the circumference of the pole wheel. Short pole shoes in the shape of sideways Ls having their first terminal ends are also positioned at equal angular intervals about the circumference of the pole wheel. The first terminal ends of the short pole shoes are positioned midway between the first terminal ends of the long pole shoes. A laminated coil core which carries magnetic flux from the pole shoes is in fixed position inside of two primary coils. The magnetic pole wheel contains a radial array of permanent radial magnet segments around the circumference of the pole wheel. The magnet segments are arranged in an alternating array of north and south poles toward the first terminal ends of the long and short pole shoes.

To generate magnetic flux changes necessary to induce current and voltage pulses in the primary coils, the permanent magnet pole wheel carrying the permanent magnet segments is rotated inside of the radial array of first terminal ends of the long and short pole shoes by a pole wheel shaft. When a segment magnet moves from one terminal end of a pole shoe to a terminal end of an adjacent pole shoe, there is a complete reversal of magnetic flux in both and in fact all of the pole shoes. The laminated core in the center of the two magneto primary coils carries the magnetic flux from the pole shoes. The magnetic flux reversal induces a primary current and voltage in the two magneto primary coils. The current from each of the magneto primary coils is carried to a separate set of points and condenser. Each set of points is electrically connected to a separate high voltage transformer which provides the ignition spark to a distributor. The two sets of points can be positioned on the magneto breaker plate to open at the same time to give a stronger spark or the points can be positioned to open sequentially to give a longer dwell time. The two sets of points can be electrically connected to a three position switch, the first position providing an electrical connection from the first set of points in the closed condition to ground to provide an ignition spark generated in response to the first set of points to open, the second position providing an electrical connection from the second set of points in the closed condition to ground to provide an ignition spark generated in response to the second set of points to open, and the third position providing and electrical connection from both the first and second set of points in the closed condition to ground to provide an ignition spark generated in response to the opening of both the first and second sets of points.

The operation of the present magneto is as follows. The magnetic pole wheel has alternate north and south pole faces. This pole wheel rotates in the center of a radial array of pole shoes. These pole shoes are alternately connected to opposite ends of a laminated coil core onto which identical but separate coaxially arranged primary coils are wound on the same section of the core. Two adjacent parallel wires are employed in the winding. Fundamental in the design of the present invention is the concept that using twin but separated coaxial coil windings allows each individual turn of each coil to react to the identical flux density as each turn of its twin to generate identical current and voltage at the same identical position on the sign wave.

Each primary coil of the magneto is connected to a separate set of points. When the points are opened the current generated in each of the magneto primary coils is conducted to a separate high voltage coil. Each high voltage coil transforms the chopped DC output from the corresponding magneto primary, to a high voltage alternating polarity chopped DC output. The two high voltage chopped DC outputs are then directly electrically connected to produce an enhanced chopped DC output. It is essential that the two high voltage alternating polarity DC outputs be in phase, because the portions of the outputs which are not in phase will cancel each other out which is the opposite of the goal of the present invention.

Factors which cause the high voltage outputs to be out of phase include variations in primary core hysteresis which occurs if different primary cores are used to generate a current in a magneto. The out of phase problem is also created if different magnetic materials are employed to generate a current in a magneto. These are some of the problems, Scott would have faced had he tried to combine high voltage outputs which he did not. There was no reason to, Scott was firing two sets of plugs.

The preferred magneto contains the terminal ends of L shaped pole shoes surrounding a magnetic pole wheel carrying radial segment magnets. The magneto is preferably in a cylindrical housing.

BRIEF DESCRIPTION OF THE DRAWINGS

FIG. 2 is a circuit diagram of the redundant magneto ignition system of the present invention.

FIG. 2A shows a coupling unit that can be employed to combine the two high voltage outputs of FIG. 2.

DESCRIPTION OF THE PREFERRED EMBODIMENTS

Figure 1:
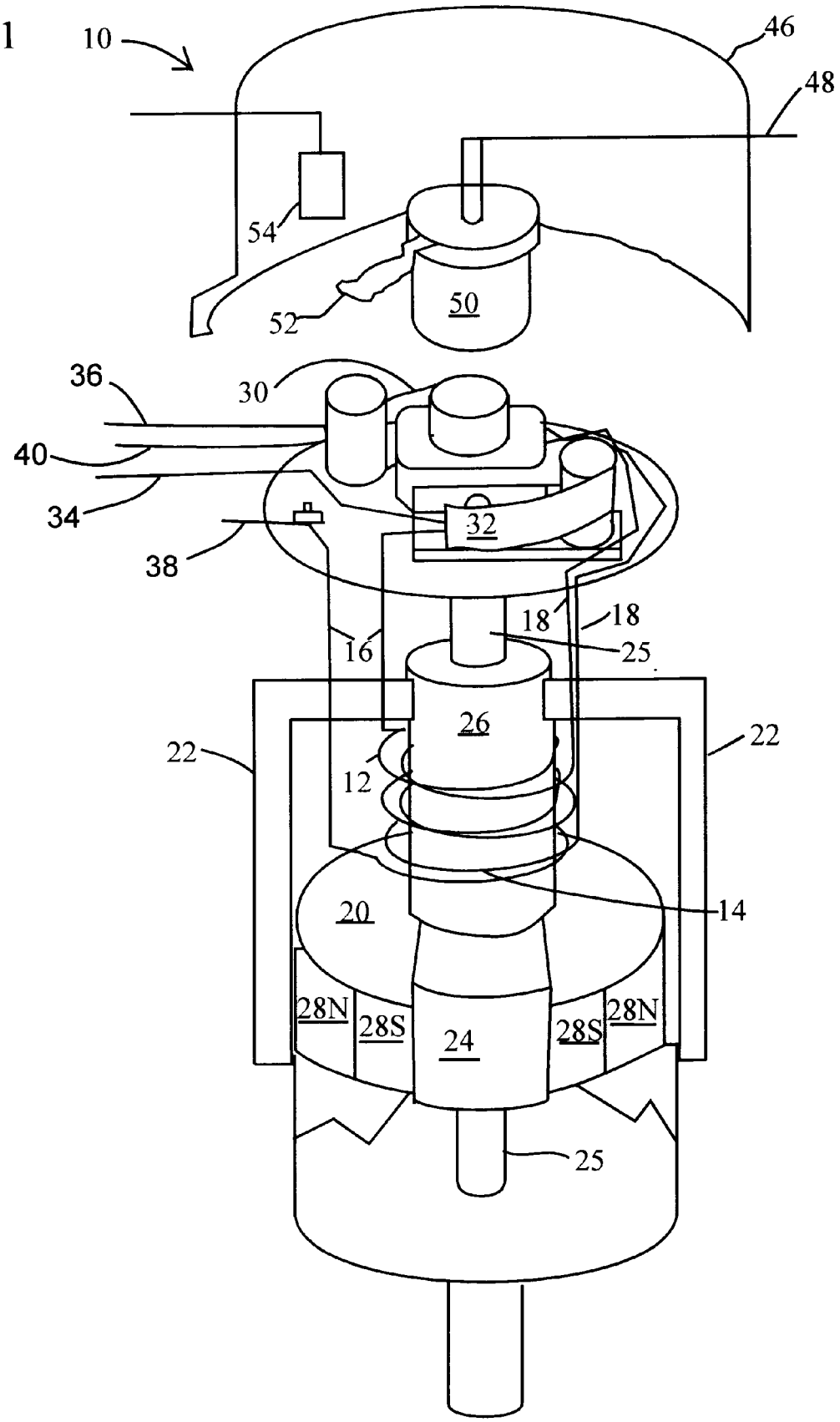
FIG. 1 shows double primary windings in the preferred magneto of the present invention.

Turning now to FIG. 1 there is shown a sectional incomplete view of magneto 10 of the present invention. Magneto 10 was initially a VERTEX magneto manufactured by TAYLOR VERTEX of Blue Bell Pa. 19422. Magneto 10 was modified by removing the primary and secondary coils and replacing them with two primary coils 12 and 14, and no secondary coils. The two primary coils 12 and 14 were encapsulated in epoxy. Instead of winding the primary coil with one wire, two wires 16 and 18 were use. The two wires during and after winding were adjacent, parallel and radially spaced the same distance from the laminated coil core 19.

The VERTEX magneto 10 has an upper housing and a lower housing (not shown). Permanent magnet pole wheel 20 rotates inside of the housing. Four long pole shoes 22 in the shape of inverted Ls having their first terminal ends positioned at 90° intervals about the circumference of the pole wheel are affixed to the upper housing. Four short pole shoes 24 in the shape of sideways Ls having their first terminal ends positioned at 90° intervals about the circumference of the pole wheel are affixed to the lower housing. The spacing between the first terminal ends of long pole shoes 22 and first terminal ends of the short pole shoes 24 is 45°. Magnetic pole wheel 20 is rotated about primary coils 12 and 14 by pole wheel shaft 25. Laminated coil core 19 which carries flux from the other terminal ends of pole shoes 22 and 24 is in fixed position inside of primary coils 12 and 14.

To generate the magnetic flux changes necessary to induce current and voltage pulses in primary coils 12 and 14, permanent magnet pole wheel 20 carrying permanent radial magnet segments 28N and 28S is rotated inside of the first terminal ends of fixed long pole shoes 22 and fixed short pole shoes 24 by pole wheel shaft 25. There are four segment magnets for a four cylinder engine. The magnets are arranged as 28N alternating north toward the terminal end of the pole shoes and 28S south toward the terminal end of the pole shoes. When a magnet segment 28N having a north pole oriented toward a pole shoe 22 aligns with a pole shoe 22, an adjacent magnet segment 28S having a south pole oriented toward a pole shoe 24 aligns with an adjacent pole shoe 24.

When the permanent magnet pole wheel 20 rotates a 90° increment, the result is a complete reversal of the magnetic flux in the pole shoes 22 and 24 and the laminated core 19 which carries magnetic flux from the pole shoes 22 and 24. The magnetic flux reversal induces a primary current and voltage in primary coils 12 and 14.

As is shown in FIG. 2, the current generated in primary coil 12 is carried to breaker points 30, and condenser 31, by wire 16 from magneto primary coil 12. The other end of coil wire 16 goes to a switch to be described later to be grounded to permit magneto operation. The current generated in primary coils 14 is carried to breaker points 32, and condenser 33, by wire 18 from magneto primary coil 14. The other end of coil wire 18 is goes to a switch to be described later to be grounded to permit magneto operation. The wires 34 and 36 from breaker points 30 and 32 go to high voltage transformers 42 and 44 shown in FIG. 2. The outputs of the high voltage transformers 42 and 44 are conducted by wires 45 and 46 to a common lead 48. The electrically connected outputs are then fed to distributor 49 of magneto 10 through common lead 48 to rotor 50, and through rotor 50 to rotating brass arm 52 which distributes the high voltage current through a radial series of high voltage terminals 54 to the spark plugs of an internal combustion engine. The conduits 45 and 46 which feed the outputs of the high voltage transformers 42 and 44 are optionally coupled by a coupling unit 56 to prevent failure in one high voltage system from adversely effecting the other (see FIG. 2A).

Figure 3:
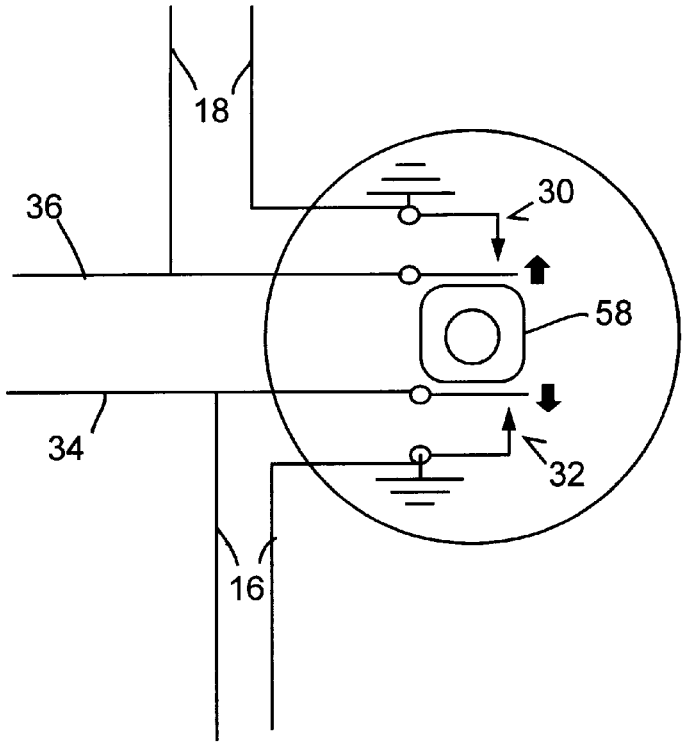
FIG. 3 is a top view of the magneto of the present invention with the distributor cap removed showing the points opposed at 180° from each other.
Figure 4:
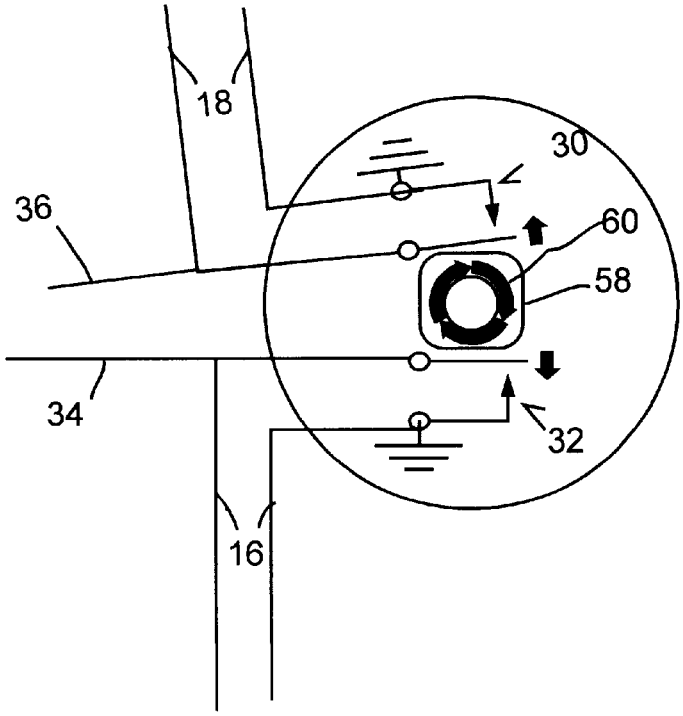
FIG. 4 corresponds to FIG. 3 except that the points are positioned at a lesser angle.

As shown in FIG. 3, the rotation of cam 58 causes breaker points 30 and 32 to open and close. The breaker points 30 and 32 will open and close at the same time if the points are spaced 180° apart. If the points are positioned at less than 180° as is shown in FIG. 4, ignition advance as well as a longer dwell time is provided. The direction of rotation of cam 58 is shown in FIG. 4 by arrows 60.

Figure 5:
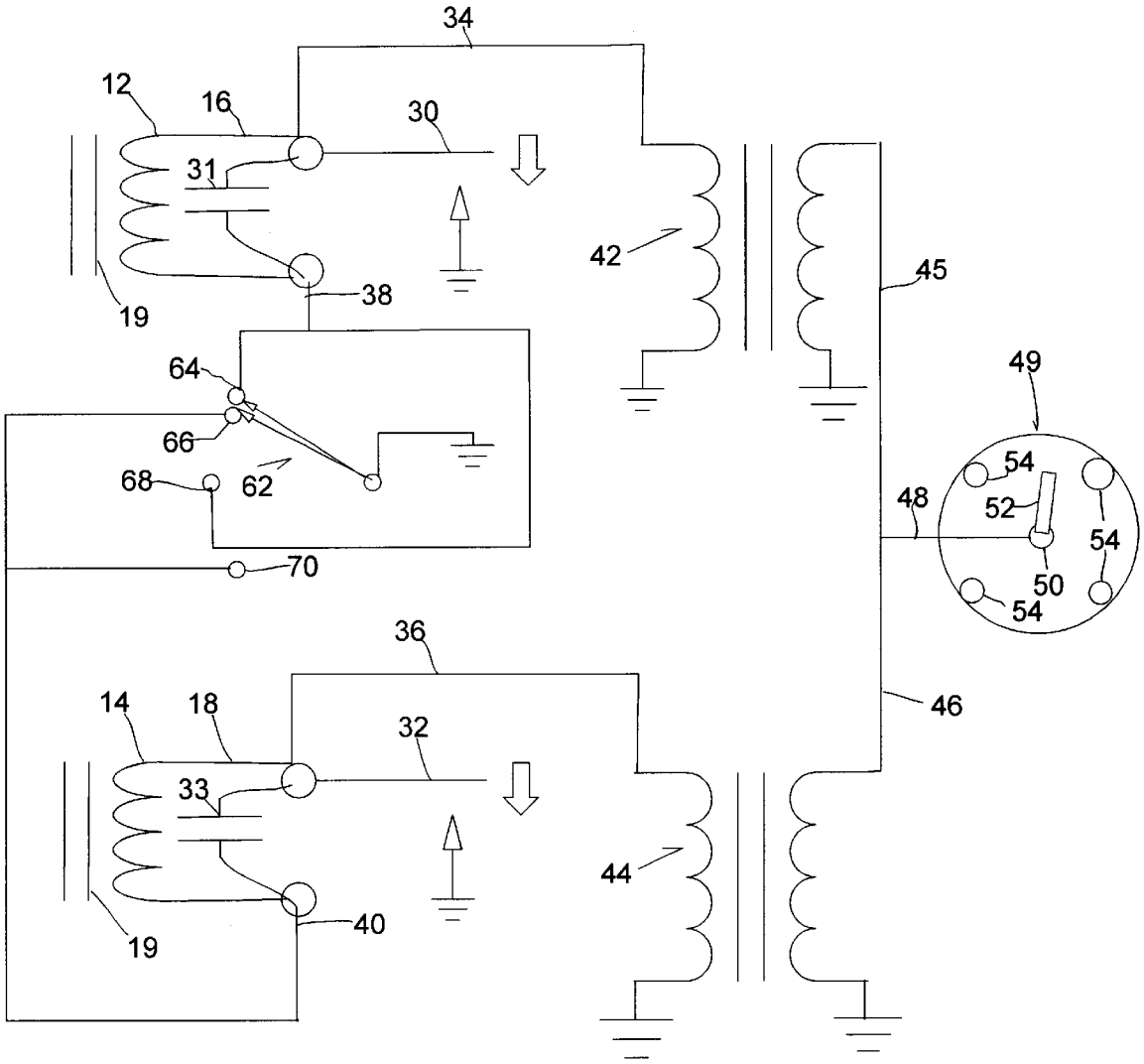
FIG. 5 is the circuit diagram of FIG. 2 containing a 3 position switch for activating a first, second or both ignition systems.

Turning now to FIG. 5, there is shown the ignition systems of FIG. 2 further containing a switch 62 for activating one or the other or both of the two ignition systems. When the switch closes the circuit to contacts 64 and 66 both ignition systems are activated giving a stronger spark when points 30 and 32 open and close at the same time as is shown in FIG.3. If one ignition system of the two fail, an ignition spark will continue to be provided by the ignition system which did not fail. When the switch closes the circuit to contact 68 only one of the ignition systems is activated. This switch position is used to test the redundant magneto before the start of a race. When the switch closes the circuit to contact 70 only the second ignition system is activated, this position also is used to test the magneto.

The dual ignition system of the present invention can also be used to provide ignition timing for starting, acceleration and top speed by using the point configuration of FIG. 4. For starting and acceleration switch 62 is set to contact 70 the timing of which is controlled by points 32. For high speed driving the switch is set to contact 68 which gives a spark advance controlled by points 30. For a hotter spark having a longer dwell time switch 62 is set to contacts 64 and 66 activating both ignition systems. The switching can also be made automatic in response to engine rpm, intake vacuum and other sensed conditions.

The present invention is also applicable to other magnetos such as the Mallory magneto which has a rotating inner magnets having alternate outwardly facing north and south pole faces surrounded by a series of coils positioned in a circle about the rotating magnets. Each coil of the Mallory magneto has a single primary winding and a single secondary winding. By replacing the single primary winding and the single secondary winding with two primary windings the advantages of the present invention can be obtained in the Mallory magneto.

Other modifications that can be made of the present invention include replacing the high voltage transformers with dual secondary windings in the magneto, though this results in a high temperature condition in the magneto, and is not preferred.

I claim:

1. In a magneto having two sets of mechanical breaker points and a laminated coil core, the improvement comprising the coils in the magneto consisting of two primary coils coaxially positioned around the laminated coil core and no secondary coil or coils in the magnetos, each primary coil electrically connected to a different set of the breaker points, two high voltage transformers separated from the magnetos, each of the sets of points being electrically connected to one of the high voltage transformers, the transformers each having a high voltage output, and an electrical connection between the two high voltage outputs to supply a single high voltage current to a distributor.

2. The magneto of claim 1 wherein the two sets of points are positioned to open and close at the same time whereby a higher intensity ignition current is provided.

3. The magneto of claim 2 wherein the two sets of points are positioned to close at different times providing a longer dwell time for an ignition spark.

4. The magneto of claim 3 further characterized by a three position switch the first position providing an electrical connection from the first set of points in the closed condition to ground to provide an ignition spark generated in response to the first set of points to open, the second position providing an electrical connection from the second set of points in the closed condition to ground to provide an ignition spark generated in response to the second set of points to open, and the third position providing an electrical connection from both the first and the second set of points in the closed condition to ground to provide an ignition spark generated in response to both the first and the second set of points to open.

5. The magneto of claim 1 wherein the terminal ends of L shaped pole shoes surround a magnetic pole wheel carrying radial segment magnets.

6. The magneto of claim 1 wherein the magneto is in a cylindrical housing.

7. A method of converting a conventional magneto having one primary and one secondary coil on one laminated coil core to a magneto having a redundant coil system comprising removing the one primary and one secondary coil and replacing the removed coils with two primary coils and no secondary coils.

8. The method of claim 7 wherein the two primary coils are formed by winding two parallel wires around a single laminated coil core.

9. A method of generating a redundant high voltage ignition current for an internal combustion engine comprising rotating a magnetic pole wheel in a radial array of pole shoes which are integral with a magnetic core to generate a series of expanding magnetic fields in the pole shoes and core, generating two separate electrical currents from two identical coils positioned on the same section of the core, conducting the two separate currents to two separate high voltage transformers having high voltage outputs, and combining the high voltage outputs of the two high voltage transformers for input to a distributor of an internal combustion engine.

* * * * *